US006104286A

United States Patent [19]

Luquette

[11] Patent Number: 6,104,286

[45] Date of Patent: Aug. 15, 2000

[54] MONITORING ALARM SYSTEMS

[76] Inventor: Mark H. Luquette, 6357 Twonotch Ct., Dublin, Ohio 43016

[21] Appl. No.: 09/098,156

[22] Filed: Jun. 16, 1998

Related U.S. Application Data

[63] Continuation-in-part of application No. 08/677,830, Jul. 10, 1996, abandoned.

[51] Int. Cl.[7] ..... G08B 29/00

[52] U.S. Cl. ..... 340/506; 340/54; 340/517; 340/531; 340/538

[58] Field of Search ..... 340/506, 511, 340/517, 521, 531, 538, 635, 650, 651

[56] References Cited

U.S. PATENT DOCUMENTS

| | | | |
|---|---|---|---|
| 4,138,670 | 2/1979 | Schneider et al. | 340/628 |
| 4,141,007 | 2/1979 | Kavasilios et al. | 340/500 |
| 4,144,528 | 3/1979 | Johnson | 340/500 |
| 4,162,489 | 7/1979 | Thilo et al. | 340/628 |
| 4,176,346 | 11/1979 | Johnson et al. | 340/628 |
| 4,191,946 | 3/1980 | Knox et al. | 340/628 |
| 4,194,192 | 3/1980 | Albinger et al. | 340/628 |
| 4,207,558 | 6/1980 | Kunzer | 340/628 |
| 4,517,555 | 5/1985 | Marsocci et al. | 340/628 |
| 4,586,028 | 4/1986 | McKinzie | 340/500 |
| 4,745,398 | 5/1988 | Abel et al. | 340/500 |
| 4,972,181 | 11/1990 | Fiene | 340/628 |
| 5,627,515 | 5/1997 | Anderson | 340/517 |

*Primary Examiner*—Daryl Pope

[57] ABSTRACT

Typical apparatus according to the present invention for detecting a predetermined type of condition (such as the presence of smoke) at a given location and providing an indication (typically audible and/or visible) of the presence of such condition, comprises an electrical detector responsive to the type of condition, for providing a potential difference of at least a predetermined amount between two predetermined points; first circuitry for connecting at least a substantial fraction of the potential difference to an electrical relay or relay analogue in the apparatus so as to provide a predetermined first indication; and second circuitry responsive to a condition in the detector or in the first circuitry that is outside of a predetermined range, and thus of possible detriment to the optimum performance of the apparatus, to provide a predetermined indication. Typically the first circuitry provides one indication concerning the presence or absence of smoke and the second circuitry provides a different indication concerning the presence or absence of possible trouble in the apparatus.

5 Claims, 2 Drawing Sheets

MONITORING ALARM SYSTEMS

This is a continuation in part of U.S. patent application Ser. No. 08/677,830, filed Jul. 10, 1996, now abandoned

BACKGROUND OF THE INVENTION

1. Field of the Invention

This invention relates to alarm systems and detectors or peripheral devices such as those that connect smoke alarms to central alarm panels. It has to do typically with fail safe sensitive monitors and signalers for interconnect lines of AC-powered smoke alarms with battery backup.

2. Description of the Prior Art

Alarm systems often contain multiple sensors including smoke detectors, heat detectors, motion detectors, and switches that determine the open or closed state of a door or window. In some systems the individual sensors or a plurality of sensors are monitored by the system using one or more electronic loops, and the system sounds an alarm when one of the sensors is triggered. Such systems and loops are discussed in the prior art (U.S. Pat. Nos. 4,141,007; 4,144,528; 4,162,489; 4,176,346; 4,517,555; 4,191,946; 4,586,028; 4,745,398). In other types of alarm systems, the sensors themselves may contain alarm horns. Such devices may be standalone devices or be interconnected such that if one is triggered, the others also become triggered by an interconnect line. Such circuits are described in the prior art (U.S. Pat. Nos. 4,194,192; 4,207,558; 4,972,181; 4,138,670).

This interconnect mode of operation is available in AC powered smoke detectors with battery back up. One such detector is the model 86RAC manufactured by BRK Electronics of Aurora, Ill. The backup is a 9-volt battery, and when the alarm is activated, something less than 9 volts DC is available on the interconnect line at a maximum current of approximately 6 milliamps. Total available power available may be considerably less if a poorly charged battery is required to power the interconnect line. This smoke detector is sold as a stand alone smoke alarm system with no UL approved means offered by the manufacturer to connect it to a central alarm system panel which could then call an alarm company.

Thus, if someone with AC smoke detectors with battery backup and interconnect capabilities (AC-DC-interconnect detectors) wanted to have smoke detectors connected to a central alarm panel, they would have to buy a different type of smoke detector manufactured for that purpose. These additional detectors are DC powered smoke detectors. There are fundamental differences in the operation of these smoke detectors that are important to appreciate in order to understand the operation of the present invention. Typically, the DC detectors have no horn. When they sense smoke, they communicate this condition to the central alarm panel by producing a short or near short across a loop from the central alarm panel. The loop is created by two leads from the panel, which are joined at their free ends by a so-called "end of line resistor." The central alarm panel circulates current through the loop. The panel expects a predetermined amount of current to be in the loop, based on the loop resistance generated by the end of the line resistor. If a break or high impedance state occurs in the loop, the panel recognizes the decrease or loss of current and reports this "trouble state" to the alarm user as a unique signal that differs from the signal that would be used if the detector sensed smoke. The signal may be audible or visual or both. If the central alarm system panel is so equipped, it will also call an alarm company and report the condition.

Leads from the DC smoke detector(s) make contact with the loop such that the detector is wired in parallel with the end of line resistor. Thus, when smoke is detected and the detector shorts the loop, the central alarm panel notes the change in the loop current from the predetermined value to a much higher current which is limited by resistance in the circuitry supplying current to the loop. The central alarm panel then activates a unique audible and/or visual signal for the alarm user and, if equipped, calls an alarm company.

Thus, when connecting DC smoke detectors to a central alarm panel, one uses a loop from the panel, and the loop is of special type that can appreciate three different states. In the "no alarm, no trouble state" a predetermined current is noted circulating through the loop. In a "trouble state," low current is noted in the loop. In the "alarm state" high current is noted in the loop. This type of loop will be referred to in the specification as a "smoke detector loop." This designation will distinguish it from the other type of loop typically offered by central alarm panels—the "normally closed loop." This latter type of loop is supplied with a predetermined current from the central alarm panel that senses the presence or absence of the current. Such loops are typically wired with a switch in series. An example is a magnetic switch on a window that maintains a closed loop when the window is closed and an open switch when the window is open. Such loops cannot distinguish a "trouble state" from an "alarm state" as both conditions produce the same result, namely, opening the loop.

The AC-DC-interconnect detectors are inexpensive and sometimes required by building codes in new constructions. The DC smoke detectors are considerably more expensive and if added to the system will add substantial cost. It would thus be advantageous to have a circuit available that would allow one to interface the AC alarms to a central alarm system panel.

This might be accomplished by a relay that would open a normally-closed loop from a central alarm system panel when the interconnect line goes hot. There are, however, two problems with that approach.

1. Conventional relays would not be able to be powered by minimal battery power should the AC power fail.
2. The relay would never be opened if the interconnect line was disrupted between the active alarm and the relay.

A desirable circuit would thus be capable of being powered by a weak battery and be activated by discontinuity of the interconnect line. Furthermore, the circuit should be fail-safe, which means that failure of any component in the circuit would result in opening of the alarm loop. This is a quality that would be advantageous if not necessary in obtaining a listing from the Underwriter's Laboratory (UL). Such listing would almost certainly be required in order for contractors to install the device.

Line monitors and fail safe circuits are known, but none are designed as stand alone circuits with the inherent simplicity of the present invention or for the same type of purpose—the interfacing of AC smoke detectors having battery backup and interconnect capabilities to a central alarm system panel. That interconnect lines were described for use in self powered smoke alarms (U.S. Pat. Nos. 4,194,192; 4,207,558) more than 15 years ago and that to date no UL-APPROVED device to couple those interconnect lines to central alarm panels has been made commercially available speaks for the lack of obviousness of the circuitry of this invention.

SUMMARY OF THE INVENTION

New residential constructions are often required by code to have smoke detectors installed on each floor of the dwelling, and in some codes, they must also be installed in each bedroom. Additional specifications mandate that the detectors be AC powered, have a battery back up in each detector, and be interconnected (by an interconnect line) such that if one detector goes into alarm, they all go into alarm. This type of detector, described above in the "Background of the Invention," will be referred to as an AC-DC-interconnect detector. The main purpose of the present invention (hereinafter often referred to as SMAS, for "Sensitive Monitor And Signaler") is to connect arrays of such smoke detectors to a central alarm panel such that an alarm or trouble condition can be communicated to a remote monitoring station.

The SMAS accomplishes this by monitoring the status of the interconnect line. Two typical embodiments are described. In the first embodiment (FIG. 1) the detectors are connected via the SMAS to a "normally-closed loop" from the central alarm panel. When the status is "no alarm," the loop from the central alarm panel is held closed by the SMAS. When the status is "alarm," the said loop is opened by the SMAS. This embodiment additionally provides fail safe features by signaling an "alarm" condition when any part of the circuit is interrupted, that is, if the SMAS circuit loses power, if the interconnect line is broken, or if the loop to the central alarm panel is broken. Such conditions are typically referred to as a "trouble state". Thus, this embodiment does not allow the central alarm panel to distinguish an "alarm state" from a "trouble state."

In the second embodiment (FIG. 2), additional circuitry is added to the first embodiment such that the SMAS can interface with a "smoke detector loop" from the central alarm panel rather than a normally closed loop. In a "smoke detector loop" the central alarm panel recognizes an "alarm state" when the loop is shorted (or the loop resistance is very low). It recognizes a "trouble state" when there is a break in the loop. Consequently, this embodiment of the SMAS allows the alarm panel to distinguish these two states.

Another desirable feature of the SMAS is that it is operational even when the AC power to the smoke detectors is absent and the battery back ups are poorly charged.

DESCRIPTION OF PREFERRED EMBODIMENTS

Figure 1:
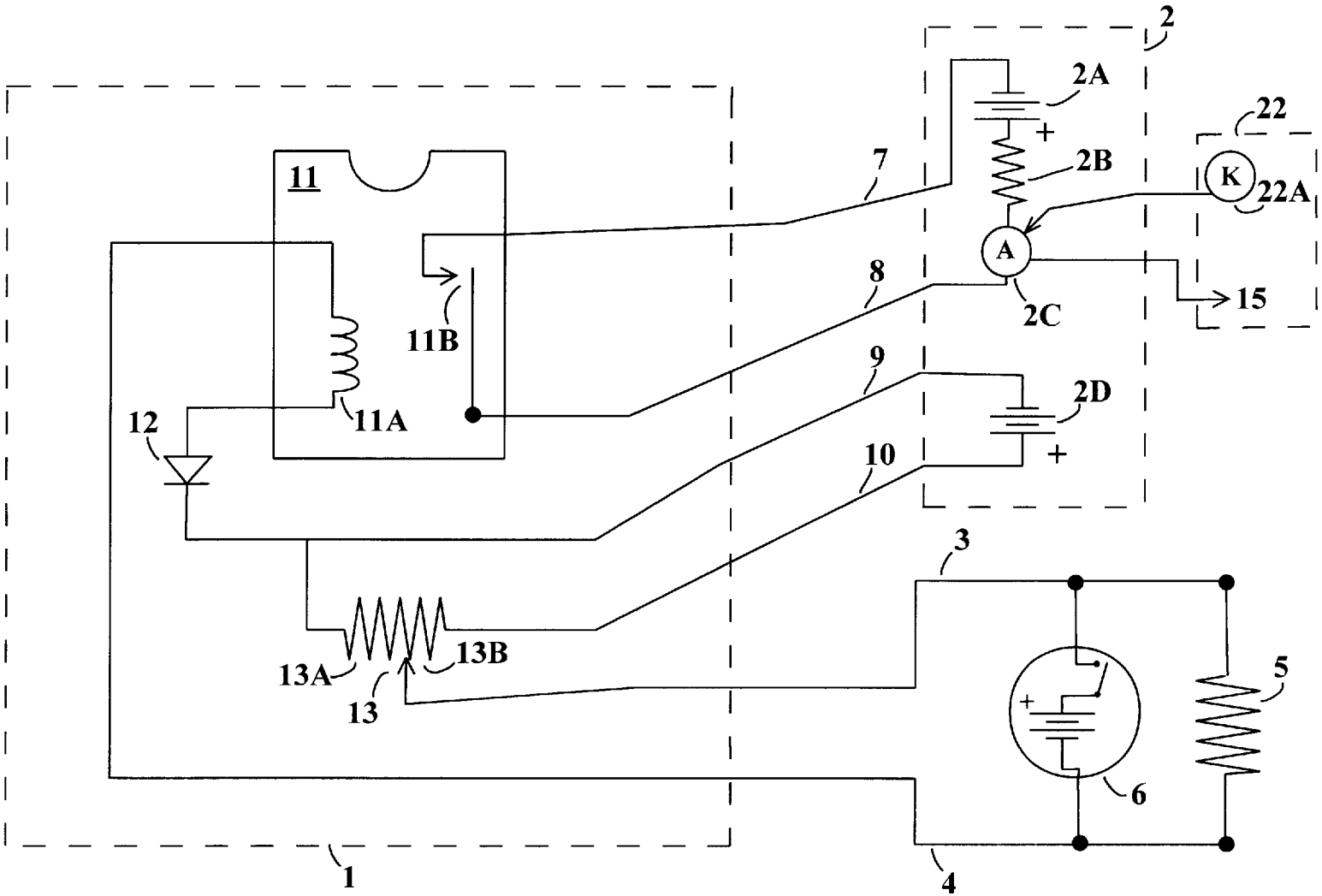
FIG. 1 is a schematic circuit diagram showing a typical simplified embodiment of the Fail Safe Sensitive Monitor And Signaler for Interconnect Lines of AC Powered Smoke Alarms with Battery Back-Up (SMAS) according to the present invention. Circuit 1 is shown connected to a central alarm panel 2 and the smoke alarm system formed by an interconnect loop 3,4,5 and at least one smoke detector 6. Additionally, an alarm state indicator 15 is connected to the central alarm panel 2.

Referring now to FIG. 1, the fail safe Sensitive Monitor And Signaler for interconnect lines of AC powered smoke alarms with battery backup (SMAS) circuit 1 interfaces with an external source of power 9,10 and two electronic loops—an alarm loop 7,8 and an interconnect loop 3,4,5.

The power and alarm loops come from a central alarm system panel 2. The power is DC and typically is supplied at 2D either from an electronic DC power supply or by a battery. The alarm loop, originating at 7,8 comprises a direct current source 2A, a current limiting series resistor 2B, and a current monitoring device 2C. Current in the loop 7,8,11B thus is limited in the panel 2, which is programmed to expect the loop to be normally closed at 11B. The processing is done using the keys 22A on the key pad 22. When the alarm loop 7,8,11B is open, the alarm system circuitry 2C in the panel 2 recognizes an "alarm state" and signals the user by turning on a horn a other audible or visible signaling device 15 shown here but not limited in location to the key pad 22. Opening of the loop can occur as a physical break in the loop or opening of the relay contacts 11B. Any condition that eliminates power to the relay coil 11A or lowers the power to the coil beyond what is needed to maintain closed relay contacts will result in open contacts at 11B and be perceived by the central alarm panel 2 as an "alarm state." Examples of such conditions include loss of power at 9,10 to the SMAS, a break in any line feeding power to the relay coil 11A, and reverse biasing of the switching diode 12.

The interconnect loop 3,4,5 is created by joining one end of an interconnect line 3 with a neutral line 4 via and end of line resistor 5 which also has a current limiting function. The interconnect line is one of three connections that can be made with the smoke detector 6. The other two connections are for supplying 110 volts AC to the detector. One of these connections (a black wire by convention—not shown) is "hot" and the other (white by convention 4) is neutral. In addition to being the 110 volt AC neutral line, the white line 4 is also paired with the interconnect line 3 such that DC voltage can be supplied via those two lines 3,4. Such voltage is supplied by the smoke detector 6 on the interconnect line (anode) 3 and neutral line (cathode) 4 when the detector 6 senses smoke. A plurality of detectors 6 (only one of which is shown in FIG. 1) can be interconnected in parallel using the neutral 4 and interconnect 3 lines with the result that when one alarm 6 sounds because smoke has been detected, the DC voltage on the interconnect 3-neutral 4 line results in all interconnected detectors 6 sounding an alarm.

The interconnect loop has power applied from the SMAS at 3,4. The power, limited by a voltage divider 13 (comprising a variable potentiometer 13A,13B in FIG. 1), is insufficient to trigger the detectors 6 to sound an alarm. Current from the voltage divider 13 leaves the SMAS 1 at 3 to circulate through the interconnect loop 3,4,5 and then returns to the SMAS 1 at 5. It then circulates through the previously described relay coil 11A, then a switching diode 12, then back to the cathode 9 of the external power.

When the smoke detector 6 senses smoke, it applies power to the interconnect line as described above and reverse biases the switching diode 12 resulting in loss of power to the relay 11A and opening of the alarm loop 7,8,11B at 11B. Tolerances on the circuit are very tight. The voltage on the interconnect line in the described embodiment prototyped with the 86RAC smoke detector (manufactured by BRK Electronics of Aurora, Ill.) must be maintained between approximately 1.75 and 1.95 volts DC. The circuit design also allows for a very depleted 9 volt battery to still be effective in triggering an alarm. As little as 1.1 milliwatt at 2 volts (direct current) is capable of reverse biasing the switching diode.

Typically mounted on an etched printed circuit board in a plastic enclosure (not shown), the circuit of FIG. 1, independent of said enclosure, connectors for interfacing the two loops and power, and the end of line resistor 5, consists of only three components: the potentiometer 13, the relay 11, and the switching diode 12. A prototype has been constructed and operates as expected.

Figure 2:
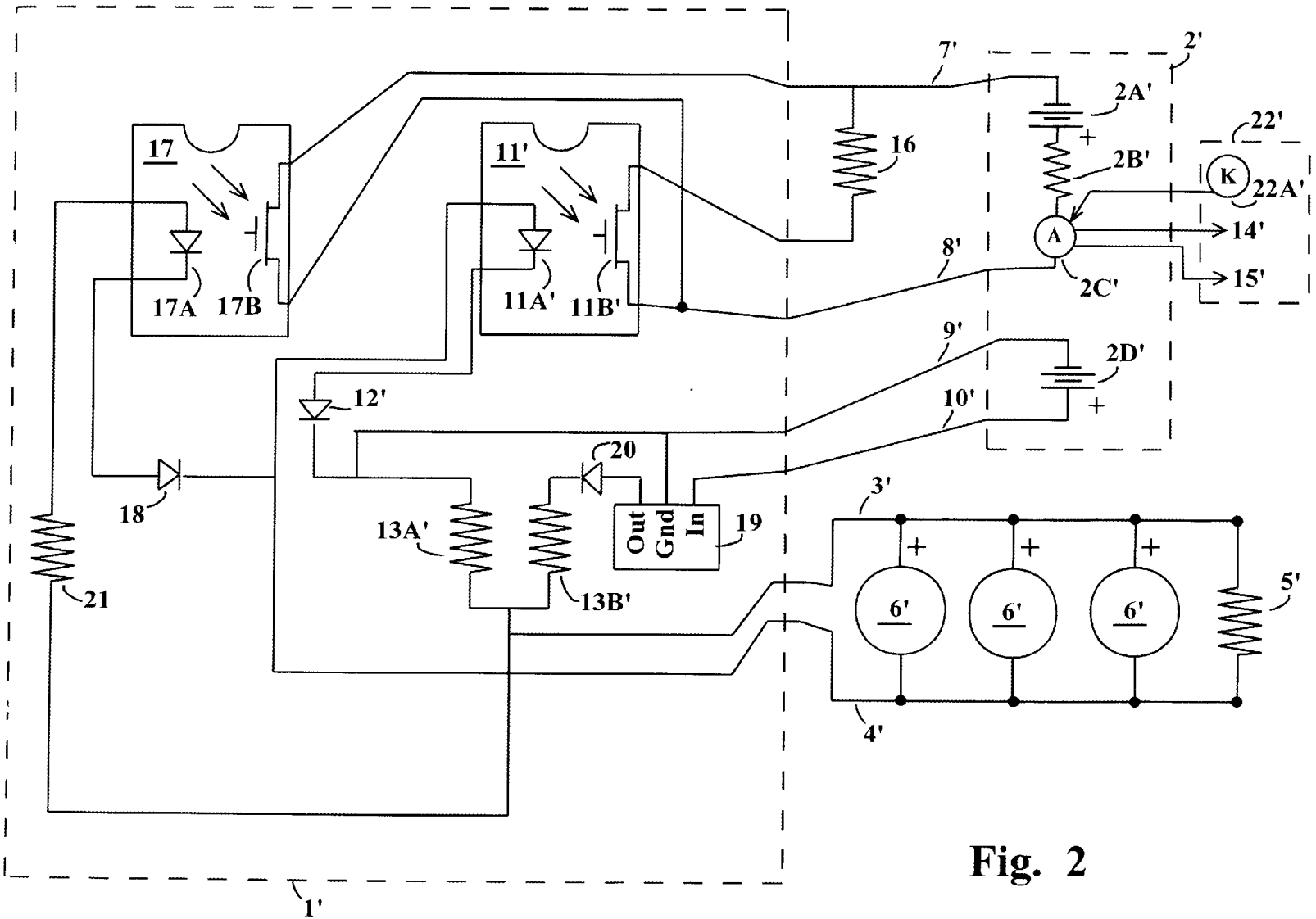
FIG. 2 is a diagram similar to FIG. 1 showing a typical embodiment of the invention that includes additional circuitry and functions. The circuit 1' is shown connected to a central alarm panel 2', a smoke alarm loop-end of line resistor 16, an interconnect loop 3',4',5', and a plurality of smoke detectors 6'. Additionally, indicators for a "trouble state" 14' and an "alarm state" 15' are connected to the central alarm panel 2'.

Also described in the original specification of the parent application are optional part substitutions. These part substitutions are shown in FIG. 2. A prototype was constructed using these substitutions with the above described alarm panel and accessories. It also operated as expected.

The first substitution of parts provides a more user friendly and better controlled power supply to the interconnect loop. The voltage divider in FIG. 1 is a variable potentiometer 13 that may be adjusted for a given external power supply 9,10. In FIG. 2 the variable potentiometer 13 is replaced by a pair of 1% tolerance fixed value resistors 13A' and 13B' drawing power from a narrow voltage range solid state voltage regulator 19 with a rectifier diode 20 protecting its output.

The second substitution is replacement of the standard mechanical relay 11 of FIG. 1 with a photovoltaic relay 11'. Thus the coil 11A is replaced by a light-emitting diode 11A', and the relay contacts 11B are replaced by integrated circuitry that couples an array of photo diodes to MOSFET (metal oxide semiconductor field effect transistor) circuitry as represented at 11B' by a MOSFET like symbol. As the light-emitting diode 11A' in this relay analogue cannot tolerate the reverse biasing voltage used in this circuit, it cannot be used as a switching diode. Thus, the switching diode 12' is added in series.

In embodiments of the type shown in FIG. 2, there is an addition of circuitry such that the SMAS 1' can be connected to a "smoke detector loop" (from the central alarm panel) rather than a normally closed loop. A "smoke detector loop" is one that is monitored by the central alarm panel 2' in a way that distinguishes an "alarm state" from a "trouble state." An "alarm state" is present when the smoke detector senses smoke. A "trouble state" is present when the loop is open or has high impedance.

As with the "normally closed loop," described above, the "smoke detector loop," originating at 7', 8' is a current source 2A' generated by and monitored by the central alarm system panel 2'. Current in the loop7',16, 11B',8' is limited by the resistor 2B' in the panel 2' and is also limited by an end of line resistor 16 external to the panel 2'. This resistor 16 closes the end of the "smoke detector loop" in a manner similar to the resistor 5' closing the interconnect loop at 3',4'. In a "no alarm, no trouble" state, the central alarm panel 2C' expects a defined current range to be circulating through the loop. In an "alarm state," the panel 2C' expects to see a marked increase in current flow through the loop 7',16,11B', 8' because in prior art systems, in an "alarm state," the loop would have been shorted by a DC smoke detector when it sensed smoke. It should be noted that the smoke detectors 6' in FIG. 2 can not short a loop. Instead, their way of indicating an alarm condition is by putting a voltage on an interconnect line. Thus, the SMAS translates that interconnect voltage into a short on the loop 7', 16,11B'8' to mimic the action of a DC smoke detector. In an "alarm state," the panel. 2C' signals the user by turning on a horn or other audible or visible signaling device 15.

These devices may stand alone or, as shown in the figures, 14', 15' be incorporated in a remote keypad that is used to program the central alarm system panel 2C'. Typically the keypad will have light emitting diodes with adjacent labels to indicate what state or states are present as well as audible signals specific for a given state. Additionally, liquid crystal displays may be used to provide alphanumeric information on the status of the system. Installation manuals for each system type specify the possible array of signaling devices for a given system.

In a "trouble state," the central alarm panel expects to see no current circulating in the loop because the loop has been mechanically opened or otherwise affected in a way that produces high impedance in the loop. In such a state, the panel 2C' signals the user by turning on a horn or other audible or visible signaling device 14, which provides a signal that is easily recognized as different from that emanating from the signaling device 15 which indicates an "alarm state."

These devices may stand alone or, as shown in the figures, 14',15', be incorporated in a remote keypad that is used to program the central alarm system panel 2C'. Typically the keypad will have light emitting diodes with adjacent labels to indicate what state or states are present as well as audible signals specific for a given state. Additionally, liquid crystal displays may be used to provide alphanumeric information on the status of the system. Installation manuals for each system type specify the possible array of signaling devices for a given system.

In an "alarm state" or in a "trouble state," the circuitry in FIG. 1 produces the equivalent of open relay contacts at 11B' that is recognized by the alarm panel as an "alarm state," the only altered state recognizable by a normally closed loop. Thus additional circuitry is added in FIG. 2 so that a "smoke detector loop" can be used to distinguish "alarm" and "trouble" states. In brief, an "alarm state" in detector(s) 6' will result in at least nearly shorting the "smoke detector loop" 7',16,11B' 8' by a relay analogue 17. In a "trouble state," relay 11' will open the loop. In practice, powering of the relay analogue 17 results in a loop resistance of approximately 20 ohms. Since the central alarm panel used in testing recognizes an "alarm state" when the loop resistance is below 100 ohms, 20 OHMS of loop resistance is sufficient to trigger an "alarm state" in the central alarm panel.

The additional circuitry shown in FIG. 2 includes a resistor 16, a relay analogue 17 similar to the relay analogue 11', a diode 18, and a resistor 21. The operation of this additional circuitry is as follows.

The loop from the central alarm panel 7', 8' is a "smoke detector loop" that requires an end of line resistor 16 for monitoring purposes as described above. As the value of this resistor 16 depends upon the characteristics of the central alarm panel 2', contacts are provided on the SMAS 1' for installation of this resistor 16 external to the SMAS 1'. As in FIG. 1, in a "no alarm, no trouble state" current from the SMAS 1' circulates through an interconnect loop 3', 4', 5', through a light-emitting diode 11A' of the relay 11', and back to the cathode 9' of the external power 9', 10'. This current is sufficient to power the relay 11' and maintain a closed smoke alarm loop with a fixed amount of loop resistance 16. At the same time, current from the voltage divider 13A', 13B' circulates through a light-emitting diode 17A of the second relay analogue 17. This current is not sufficient to power the second relay analogue 17 that would effectively short the "smokedetector loop" 7',8' if the relay analogue 17 were sufficiently powered.

As in FIG. 1, a break in the alarm or interconnect loops or loss of power to the SMAS results in insufficient power to the relay 11', and the "smoke detector loop" is opened. The central alarm panel 2C' recognizes this as a "trouble state" and signals the user via an audible and/or visual indicator 14'.

In an "alarm state" the smoke detector(s) 6' apply a potential difference to the interconnect loop such that the switching diode 12' is reverse biased. If the relay 17 were not functional, a "trouble state" would ensue from the opening of the alarm loop by the relay 11'. If the relay 17 is functional, in an "alarm state," its light-emitting diode 17A will receive sufficient power from the smoke detectors 6' via the interconnect 3' and neutral 4' lines to lower the resistance on the alarm loop 7',16,11B',8' to a point that an "alarm state" would be perceived by the central alarm panel 2C', and the user would be signaled via an audible and/or visual indicator 15'. The resistor 21 limits the current to the relay analogue 17 so that in a "no alarm state" it will not receive current sufficient to produce an "alarm state" signal.

A prototype of this second embodiment as in FIG. 2 was constructed using a professionally made printed circuit board with components wave soldered. It was subsequently encapsulated in epoxy potting compound and operates as expected. The central alarm system panel used in the prototype is a Model PC1575 manufactured by Digital Security Controls Ltd. (Canada). Programming of this panel was done manually using the keypad Model PC1575RK (sic) supplied with the panel. The panel was powered with a step-down transformer having an external battery backup.

While the forms of the invention herein disclosed constitute currently preferred embodiments, many others are possible. It is not intended herein to mention all of the possible equivalent forms or ramifications of the invention. It is to be understood that the terms used herein are merely descriptive rather than limiting, and that various changes may be made without departing from the spirit and scope of the invention.

Of course the detectors 6,6' need not be limited to smoke detectors. They may, for example, comprise detectors for indicating the presence of carbon monoxide, radon, or other gaseous, liquid, or solid matter, including human beings or other life. In fact the detectors 6,6' may comprise means for providing an electrical potential difference at 3,4 or 3',4' in the presence of any predetermined detectible condition, and the following claims are to be construed accordingly.

I claim:

1. An apparatus for monitoring at least one electrical detector of the type that: 1) is AC powered; 2) has battery backup; 3) has interconnect capabilities; and 4) provides a potential difference of at least a predetermined amount on interconnect lines, so as to be responsive to a predetermined ambient condition at a given location, said apparatus comprising:

first circuitry for connecting at least a substantial fraction of the potential difference to a first relay included in said first circuitry of the apparatus so as to provide a predetermined first indication; and second circuitry responsive to a potentially detrimental electrical condition in the apparatus that is outside a predetermined range, said electrical condition thus representing a potential detriment to the optimum performance of the apparatus, so as to cause said second circuitry to thereby provide a predetermined indication of the detrimental electrical condition;

wherein a smoke detector loop from a central alarm system panel is monitored by the panel to distinguish an alarm state from a trouble state, said alarm state being present when said electrical detector senses said electrical condition, and said trouble state being present when it is detected that the loop is open or has a high impedance;

wherein the smoke detector loop includes a current source generated by and monitored by the panel such that current on the loop is limited by the panel and by an end of the line resistor external to the panel, the resistor limiting the current by closing the end of the smoke detector loop; and wherein the central alarm system panel responds by:

a) in a no alarm state and a no trouble, measuring a defined current range that circulates through the loop; and b) in the alarm state, measuring a marked increase in current flow through the loop, and thereby turning on an audible or visual indicator to alert the alarm user; and c) in the trouble state, measuring no current circulating in the loop because the loop has been affected so as to produce a high impedance, thereby turning on an audible or visual indicator that is different from the indicator used in the alarm state.

2. An apparatus as in claim 1, wherein end of line resistors 16), and circuitry(1') including first relay(17), diode(18), and resistor(21), are included in the apparatus such that the smoke detector loop requires the end of line resistor(16) for monitoring, and wherein in the no alarm and no trouble states, current circulates through an interconnect loop(3,'4', 5'), through a light emitting diode(11A') of a second relay (11'), and back to the cathode(9') of the external power(2D'), this current being sufficient to energize the second relay(11') and maintain a closed smoke alarm loop with the fixed amount of loop resistance while at the same time current from the voltage divider(13A',13B') circulates through a light emitting diode(17A) of said first relay(17), this current being insufficient to energize the first relay(17) thereby avoiding an effective short of the smoke detector loop(7',8') which occurs when the first relay(17) is sufficiently powered.

3. An apparatus as in claim 2, such that a break in the alarm or interconnect loops or loss of power to circuitry(1') results in insufficient power to the second relay(11'), and the alarm loop is opened, such that the central alarm panel(2') recognizes and indicates said trouble state.

4. An apparatus as in claim 3, such that in the alarm state, the electrical detector applies a potential difference to the interconnect loop such that a switching diode(12') is reverse biased, and if the first relay(17) were not functional in said alarm state, said trouble state would ensue from the opening of the alarm loop by the second relay(11'), and if the first relay(17) is functional, in said alarm state, the light emitting diode(17A') will receive sufficient power from the electrical detector, via the interconnect(3') and neutral(4') lines, to lower the resistance on the alarm loop to a point that the alarm state would be perceived by the central alarm panel (2'); wherein the resistor(21) serves to limit the current to the first relay(17) so that the first relay(17) will not receive a sufficient amount of current to indicate an alarm state when an alarm state does not exist.

5. An apparatus for monitoring at least one electrical detector of the type that: 1) is AC powered; 2) has battery backup; 3) has interconnect capabilities; and 4) provides a potential difference of at least a predetermined amount on interconnect lines, so as to be responsive to a predetermined ambient condition at a given location, said apparatus comprising:

first circuitry for connecting at least a substantial fraction of the potential difference of a first relay included in said first circuitry of the apparatus, so as to provide a predetermined first indication;

second circuitry responsive to a potentially detrimental electrical condition in the apparatus that is outside a predetermined range, said electrical condition thus representing a potential detriment to the optimum performance of the apparatus, so as to cause said second circuitry to thereby provide a predetermined indication of the detrimental electrical condition;

wherein said circuitry allows the monitoring of AC powered electrical detectors and the integrity of the detector interconnect line such that the integrity of the interconnect line is assessed by circulating current through a loop created by the interconnect line, a neutral line, and an end of line resistor that joins them;

wherein the voltage applied to the loop is insufficient to trigger the detector but provides power sufficient to energize a second relay included in the second circuitry of the apparatus, that maintains a closed loop at a central alarm system panel; wherein loss of power to or discontinuity of the loop results in opening of the second relay and thus creates a trouble state as recognized by the panel;

wherein in an alarm state, the detector applies power to the loop and reverse biases a switching diode effectively cutting power to said second relay; and wherein simultaneously said first relay is powered and nearly shorts the loop creating an alarm state as recognized by the panel.

* * * * *